US005365763A

United States Patent [19]

Cretin et al.

[11] Patent Number: 5,365,763

[45] Date of Patent: Nov. 22, 1994

[54] DEVICE FOR SHAPING OF HELICAL FINS ON THE OUTER WALL OF A TUBE

[75] Inventors: Michel Cretin, Mellecey; Charles Marcon, Chagny, both of France

[73] Assignee: Escofier Technologie SA, Chalon-sur-Saone, France

[21] Appl. No.: 55,254

[22] Filed: May 3, 1993

[30] Foreign Application Priority Data

May 6, 1992 [FR] France ..... 92 05762

[51] Int. Cl.[5] ..... B21D 53/06

[52] U.S. Cl. ..... 72/98; 72/100

[58] Field of Search ..... 72/95, 96, 98, 99, 100, 72/107, 108

[56] References Cited

U.S. PATENT DOCUMENTS

| | | | |
|---|---|---|---|
| 2,883,894 | 4/1959 | Tsuchikawa | 72/105 |
| 3,415,090 | 12/1968 | Kirpichnikov et al. | 72/100 |
| 3,435,852 | 4/1969 | Trihey . | |
| 3,648,502 | 3/1972 | Klug et al. | 72/98 |
| 3,785,189 | 1/1974 | Asselborn et al. . | |
| 4,322,961 | 4/1982 | Greis | 72/108 |

FOREIGN PATENT DOCUMENTS

| | | |
|---|---|---|
| 891580 | 3/1944 | France . |
| 1515321 | 1/1968 | France . |
| 1527259 | 4/1968 | France . |
| 2137491 | 12/1972 | France . |
| 1125188 | 8/1968 | United Kingdom . |

*Primary Examiner*—Lowell A. Larson

*Attorney, Agent, or Firm*—Dennison, Meserole, Pollack & Scheiner

[57] ABSTRACT

A device for the formation by rolling of helical fins on heat exchange tubes to increase the heat transfer capacity of the tubes. The device comprises four forming rolls (6, 7, 8, 9) which are arranged on two carriages (4, 5) which are moved together in translation fashion by a hydraulic jack which enables the four forming rolls to bear simultaneously on the wall of a tube (2). The four forming rolls operate around the tube and are rotatably driven at equal speed by a single motor (50). The forming rolls are oriented about an axis (X2, X4, X5) which is perpendicular to the fin shaping zone. The tube (2) is driven by the forming rolls along an axis of translation.

24 Claims, 6 Drawing Sheets

DEVICE FOR SHAPING OF HELICAL FINS ON THE OUTER WALL OF A TUBE

The device which is the object of the invention is concerned with the formation of finned tubes as heat exchangers between two fluids or mixtures of liquid or gaseous fluids, or part liquid and part gaseous mixtures, one of which flows inside the tube, and the other of which flows outside the tube.

Various devices are known, which, by the use of forming rolls, permit the formation of helical fins on the outer walls of tubes of this kind, in order to increase their heat transfer capacity.

Fins of this kind can be produced, for example, by rolling two forming rolls, over the outer surface of a tube along a helical path, these rolls being disposed on either side of the tube. Each of these forming rolls comprises a plurality of circular discs which are mounted on one and the same axis. The edges of the discs gradually penetrate into the tube wall, forcing the metal of the tube in the intervals separating the discs, thereby forming at least one helical fin.

The necessary feed angle given to the forming rolls is such that the displacement of the tube relative to the forming rolls causes the formation of the helical fins.

The increase in the use of tubes as heat exchangers has revealed the advantages in having finned tubes when the metals or alloys which are used are highly resistant to corrosion by various liquid or gaseous fluids which are brought to relatively high temperatures. The thermal conductivity of metals or alloys such as stainless steels or refractory steels, titanium and its alloys, stainless or refractory alloys, and, in particular, those with a high nickel content can be low, these metals or alloys have however a relatively low cold forming aptitude.

It has been noted that in order to obtain good heat transfer properties it is desirable to be able to form helical fins of small height, small thickness and small spacing on the tube walls made of these metals or alloys.

Thus, by way of example, in the case of a height in the order of 1 mm, a proposal has been made to form a helical fin with a pitch in the order of just 1 mm or less, that is to say a number of turns per unit of length of the tube, or density, which reaches about 10 per cm (about 25 per inch) or more. The tubes thus finned have a very good capacity in terms of heat transfer. However, forming them is very difficult. Problems increase when the intention is to obtain tubes of low wall thickness, that is to say where the residual thickness after forming is int he same order as the height of the fins, or less, in order to reduce the cost of the metal used and to further improve the heat transfer capacity. Moreover, the tubes must have large unitary lengths which can reach in the order of 20 to 30m, or more.

The problems encountered in producing these tubes are revealed by a number of faults and also a number of fissures or defects in the discs of the forming rolls. These fissures or defects interfere in quite a major way with the manufacturing process, and considerably increase the cost of the finned tubes produces. The most common of these defects are cracks which are formed on the edge of the fins, tearings off of the fins due to forces applied by the forming roll discs to the side walls of the fins undergoing formation, and finally starting fissures which appear on the actual tube walls. It is noted that defects of this kind are frequent despite care being taken when known devices are used to form the fins and despite slow production speeds.

Therefore, all these problems result in very high production costs which do not permit the desired high performance heat exchange tubes to be produced economically.

The possibility has bee investigated of realising a device for forming by rolling helical fins on the outer walls of tubes made of metals relatively difficult to transform in order to obtain high eat transfer performance.

In particular, the possibility has been investigated of obtaining tubes of this kind provided with fins which are made of stainless steel or refractory steel, alloyed titanium or non-alloyed titanium, stainless alloys or refractory alloys with a high content of nickel, or other metals or alloys, combining a good resistance to corrosion and good mechanical behaviour at relatively high temperatures. The possibility has been investigated, in particular, of producing a device for shaping heat exchange tubes which permits the production of high performance finned tubes of great length under truly economical conditions.

More particularly, the possibility has been investigated of realising a device which makes it possible for tubes of this kind to be produced with a helical fin configuration, the density of which is in the order of 11 per cm (28 per inch) or more, with a fin height of about 1 mm, the thickness of the tube obtained being substantially equal or less than about 1 mm.

The possibility has also been investigated of realising a device wherein the service life of the forming rolls and of their constituent discs is satisfactory.

The device which is the object of the invention satisfies all these aims.

The device is designed for shaping, by rolling, at least one helical fin on the outer wall of the tube.

Depending on the application, the tube is a metal seamless tube or a welded tube formed of a metal or alloy which is adapted to the temperature conditions and to the type of fluid(s) with which it is in contact. The metal of the tube can be a carbon steel, a ferritic or austenitic stainless steel, a refractory steel, titanium or titanium based alloys or any other metals or alloys whose physico-chemical properties are suitable for the prevalent conditions of use.

The device according to the invention comprises two movable carriages which are disposed opposite each other on either side symmetrically of the axis of movement of a tube which is to be finned, each of the carriages comprising two forming rolls which are each mounted on a forming roll carrier head. A means of translation enables the two carriages to be brought together symmetrically into a working position where the four forming rolls come to bear on the tube to be formed, which is disposed in the axis of movement, with a predetermined tightening force. In this working position, the forming rolls are distributed about the tube, inclined at the same lead angle and in a mutual position relative to the axis of movement in such a way that each assists in forming a fin or the tube. The means of translation also enables to move the carriages apart to release the finished tube, to place the next tube in position and also to carry out control and adjustment operations or to change over tools when necessary.

The means for translation of the carriages makes it possible, in particular, for the forming rolls to be brought together and tightened, and said means is preferably formed by at least one jack, the body of which is connected to one of the carriages and the piston to the other. A synchronisation means provides for simultaneous translation of the two carriages in both directions. The synchronisation means has a swinging beam or cross beam which is mounted to a fixed pivot, the axis of which intersects the axis of translation; rigid rods or connecting rods are each connected symmetrically in pivotable manner to one end of the carriage, and the other end to one of the two ends of the swinging beam.

A means for the accurate adjustment of the travel of the tightening jack(s) is preferably used to provide reproducible tightening, in the working position, of the forming rolls against the outer wall of the tube to be shaped.

The adjustment means is preferably formed by a closure means for the pipe for supplying fluid under pressure to the jack. The closure means which is connected directly or indirectly to the piston rod of the jack has a control means such as a micrometric screw which allows accurate adjustment to be made to the length of the travel of the piston, for which the closure of the feeding pipe causes the stopping of the piston. Advantageously, a means for opening a discharge channel intervenes if incomplete closure to the supply to the jack would not immediately and completely block the piston.

Each forming roll carrier head is mounted to bear upon a bearing surface of a tool carrier which is fixed to the carriage and is able to rotate a few degrees about an axis of orientation which intersects the shaping zone of the corresponding forming roll on the tube in the working position.

In this working position, the four axes of orientation are arranged at about 90° relative to each other. Thus the stress exerted on the tube by each forming roll for forming the fins is lowered and made symmetrical when compared to existing devices having only three forming rolls distributed at 120° relative to each other about the tube.

Each forming roll is mounted to a forming roll carrier shaft which is rotatably guided on bearings fixed to the forming roll carrier head. A drive shaft arranged parallel to the forming roll carrier shaft is also mounted to bearings fixed to the forming roll carrier head and is connected to the forming roll carrier shaft by a transmission means, by gear wheels, for example, The four device shafts are connected by articulated transmission means arranged preferably about the axis of movement of the tube to a common rotary drive means which provides rotary movement at a speed which is strictly equal for the four forming rolls.

Preferably, the articulated transmission means are constituted of four shafts provided with articulated joints at their two ends, such as a cardan joint, for example, and comprising a telescopic part, the shafts being connected at one end to a drive shaft of a forming rolls carrier head and at the other end to a common rotary drive means. Preferably, the common rotary drive means has a toothed rimwheel, the axis of which corresponds to the axis of movement of the tube passing through it. A pinion which is actuated directly or indirectly by a motor means rotatably drives the toothed rimwheel and four identical pinions distributed about the axis of the toothed rimwheel at 90° relative to one another, each driving the corresponding transmission shaft directly or indirectly. A passage formed through the toothed rim wheel axis allows the passage of the tube through it during the shaping process.

The forming roll carrier shafts are disposed in such a way that the axis of orientation which intersects the shaping zone of the tube wall by the corresponding forming roll also intersects the axis of translation in the tightening position, or passes int he immediate vicinity thereof. By angularly displacing the forming roll carrier head about the axis of orientation it is thus possible to provide the corresponding forming roll with a predetermined angular inclination in order to give a pre-determined lead angle to at least one helical fin. The bearing surface of the forming roll carrier head on the bearing surface at the tool carrier end of the corresponding carriage is a plane which is perpendicular to the axis of orientation.

Advantageously, it is possible to place between the two bearing surfaces of the forming roll carrier head and of the tool carrier of the carriage one or a plurality of spacer plates which have parallel faces and which are of a controlled thickness so as to enable the spacing between the axis of the forming roll carrier shaft and the axis of movement of the tube to be shaped to be controlled. Account is therefore taken of the various external diameters of the tubes which are to be provided with fins and also of the corresponding diameters of the forming rolls used. It is thus possible to keep a tightening position for which the axis of orientation intersects the axis of movement and to respect a distribution of the 4 forming rolls at 90° about the tube, irrespective of its diameter. Under there conditions, the forces applied by each forming roll to the tube during the shaping by rolling process are borne to perfectly equal extents by the tube.

Advantageously, the angular setting of the part which can be moved of the forming roll carrier about the axis of orientation is provided by means of setting means which are introduced between a wall which is fixed to the tool carrier end of the carriage and the wall opposite a piece fixed to the forming roll carrier head.

After the lead angle has been adjusted, and after the spacing between the axis of the forming roll carrier shaft and axis of translation has been adjusted, if necessary, blocking means enable the forming roll carrier head to stop rotating relative to the tool carrier end of the carriage, thereby preventing any risk of angular displacement. The blocking means used can comprise screwthreaded rods, for example, which pass through the bearing surface of the forming roll carrier head, and are connected to the tool carrier end of the carriage.

Preferably, each of the forming roll carrier heads comprise a detachable piece in which is accommodated at least one bearing to which one end of the forming roll carrier shaft is mounted, this detachable piece being fixed in such a way that after it has been detached from the forming roll carrier head it is possible to detach it easily from the corresponding forming roll carrier shaft.

Preferably also, one of the bearings of the drive shaft which drives the forming roll carrier shaft is also accommodated in the detachable piece in order to enable this shaft to be detached, if necessary, and also the forming roll carrier shaft and transmission means which connect them together.

Preferably, each forming roll comprises a stack of revolving discs. The diameter of a plurality of these discs increases in the direction of translation of the tube in such a way as to permit the gradual shaping of fins. The shaping operation is accompanied by the elongation of the tube, with its diameter being reduced in size and also its thickness as measured beneath the fins. In the case of relatively thin tubes, a mandrel is preferably placed inside the tube which is kept in place by a retaining rod greater in length than the tube and the end of which outside the tube and to the rear of the tube is attached to a fixed point. Advantageously, the mandrel is mounted freely to rotate about the axis of movement of the tube by virtue of a bearing surface provided between the mandrel and the retaining rod or between the retaining rod and the fixed point of attachment.

The mandrel is advantageously substantially frustoconical in shape with an generatrix inclined of some degrees relative to its axis in order to support the inner wall of the tube in the zone in which the thickness of the tube has been reduced due to the action of the forming rolls. It can advantageously be adjusted in the axial position in order to control the collapsed state of the tube due to the action of the forming rolls.

Channels can be used to facilitate guidance and displacement of the tube along the axis of translation. It is necessary to line the channels with a layer of plastics material which facilitates rotational displacement of the tube subjected to the action of the forming rolls without any risk of the fins becoming caught and torn. Pinch-rolls or drive rollers disposed upstream and downstream in relation to the shaping device are advantageously used to position the smooth tube on the mandrel carrier rod and to remove the tube from the mandrel carrier rod at the end of the operation.

Along the length of the tube it is possible to keep several smooth sections, the translation of the tube thus being provided for by drive rollers and governed by proximity detection means.

To initiate the forming of fins and also to interrupt this operation at given intervals, use is made advantageously of proximity detection means such as Foucault current detection means which are disposed downstream in relation to the shaping zone at positions accurately marked out along the channel relative to the fin-providing zone. These detection means which are at least two in number are connected to electronic means which can initiate the forming of fins and also interrupt it, if necessary, in the intermediate zones not provided with fins which will later be the curved parts of the tube, for example. It is thus possible to form a plurality of zones, provided with fins, on the tube, these zones being separated by smooth zones.

The operation of providing the tube with fins is preferably initiated by electronic means which allow the forming rolls to start to rotate at a reduced speed and then for the carriages to gradually move together at slow speed, the forming rolls also thus being applied with gradual tightening. The rotational speed of the forming rolls is then increased until the normal working speed is reached. If, for example, the tubes are made of austenitic stainless steel such as 304 steel or 316 steel of about 15 to 25 mm in outer diameter and 1.5 to 2.5 mm in thickness, prior to shaping the tightening force of each forming roll is about 30+10 kN. The diameter of the forming roll is in the order of 25 to 50 mm and the normal working speed of the shaping operation can reach 4 to 10 m/min.

The example and the drawings describe an embodiment of the device according to the invention.

Figure 1:
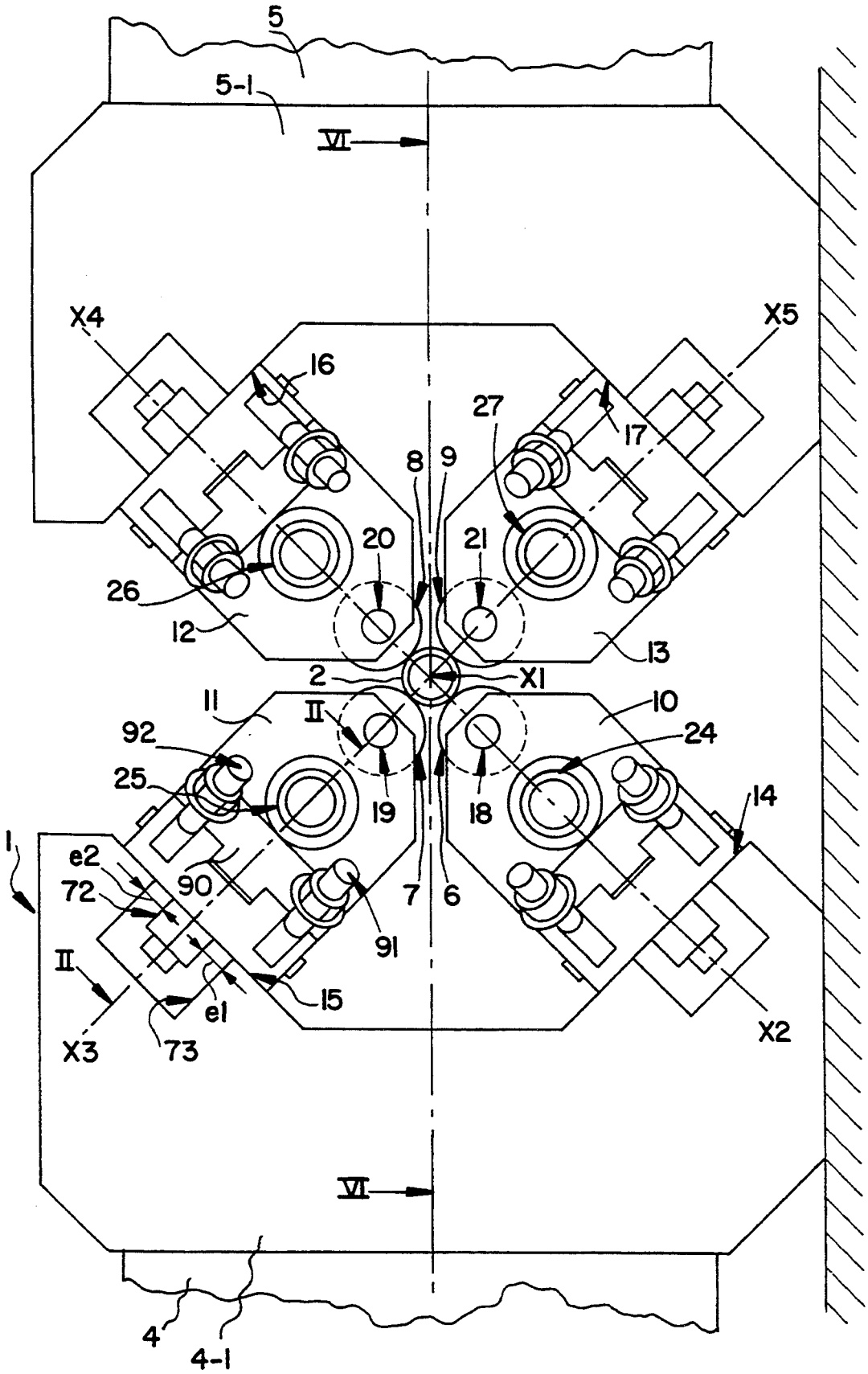
FIG. 1 is a schematic view in plan, perpendicular to the axis of translation of the tube, of the assembly which is formed by the four forming roll heads and the front end of the two carriages of the device according to the invention.

The device shown in FIG. 1 allows at least one helical fin 3 to be shaped on the outer wall of a revolving tube 2 for use in heat exchangers.

Figure 2:
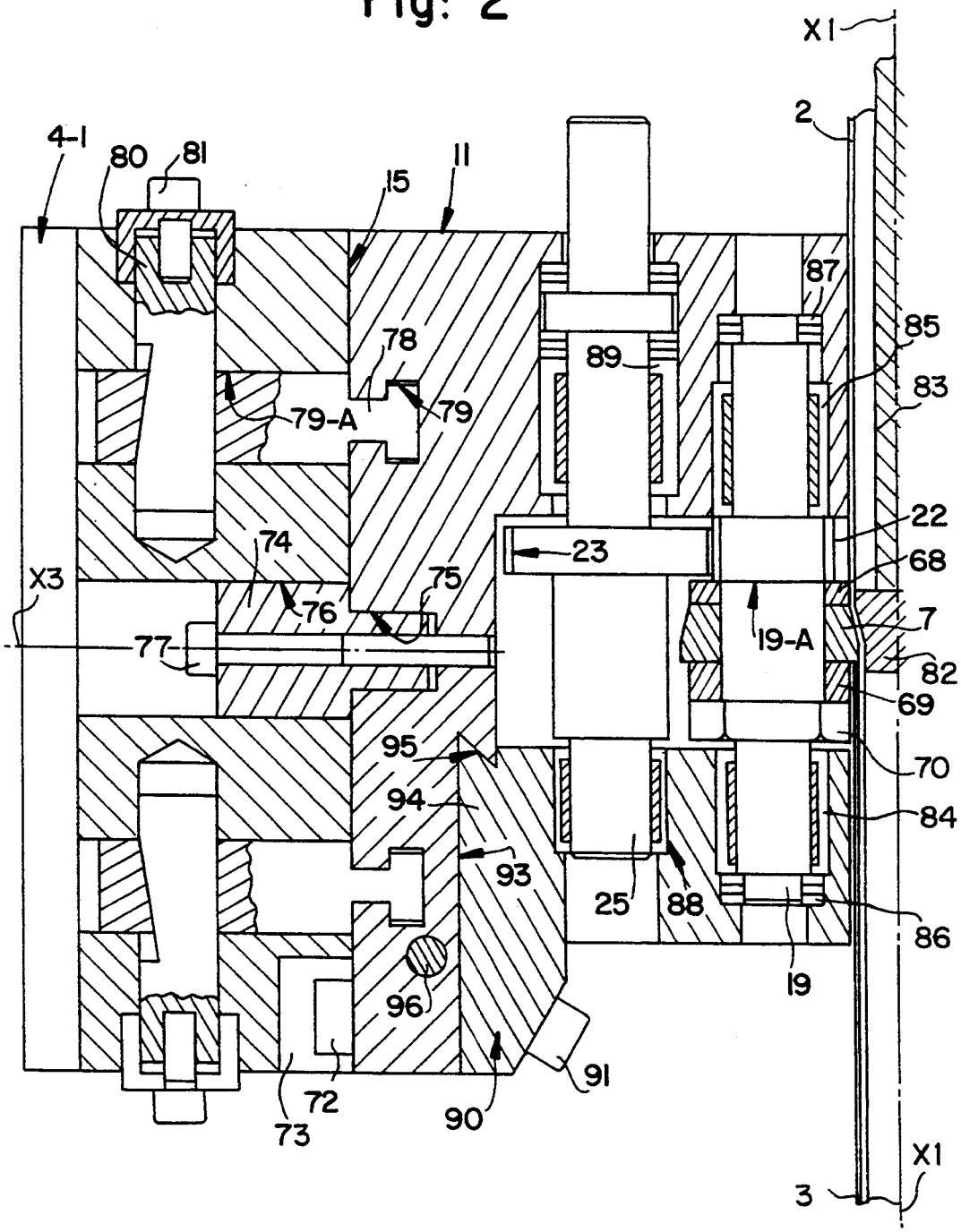
FIG. 2 is a schematic view along the sectional plane II—II of FIG. 1 of a forming roll head in a position for shaping by rolling a tube wall to be provided with fins.
Figure 3:
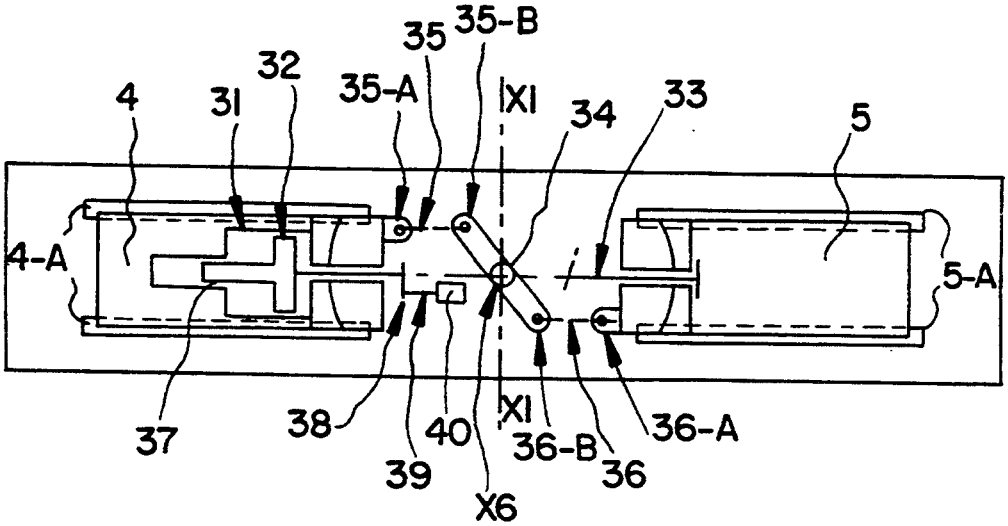
FIG. 3 is a schematic view in plan showing the lower part of the two carriages of the device according to the invention, in a position where they are moved apart, with their conjugate displacement means.
Figure 4:
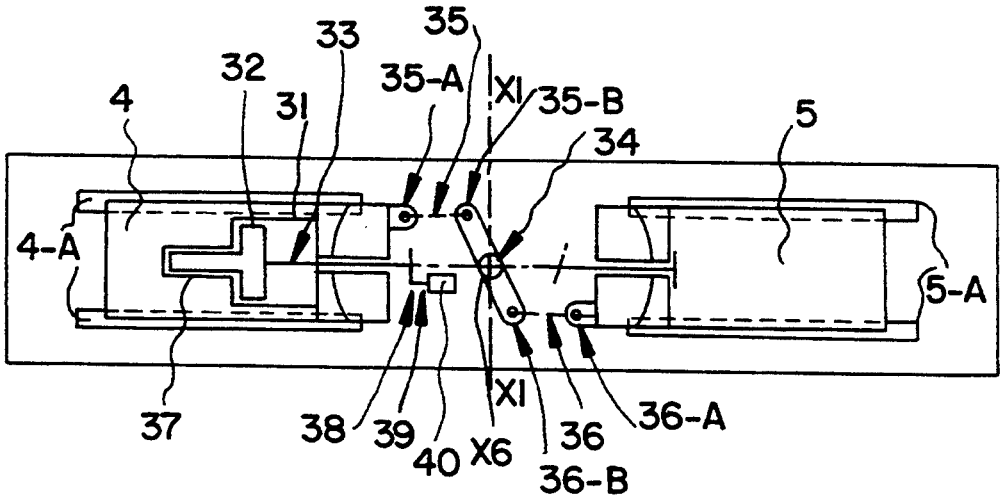
FIG. 4 is a plan view of the lower part of the carriages of FIG. 3, in a working position in which they are brought together.

The device comprises two carriages 4, 5 which are capable of sliding parallel to the plane in FIG. 1 on slides 4A, 5A shown in FIGS. 3 and 4. These two carriages are arranged opposite each other symmetrically on either side of the axis X1—X1 of translation of the tube 2. Each of the carriages comprise two forming rolls 6, 7 and 8, 9 which are rotated by the forming roll carrier shafts 18, 19 and 20, 21. The shafts are driven by the drive shafts 24, 25 and 26, 27 by virtue of a transmission means operating with geared couplings such as 22 and 23 which can be seen in FIG. 2. Each forming roll, its forming roll carrier shaft and the corresponding drive shaft are mounted on the same forming roll carrier head. The first two forming roll carrier heads 10, 11 are mounted to bear on the bearing surfaces 14 and 15 of the tool carrier end 4-1 of the carriage 4, and the other two tool carrier heads 12 and 13 are mounted to bear upon the bearing surfaces 16 and 17 of the tool carrier end 5-1 of the carriage 5. Each of the forming roll carrier heads can move a few degrees about an axes of orientation. Each of the four axes of orientation X2, X3, X4, X5 is perpendicular to the plane of the corresponding bearing surface 14, 15, 16, 17 of one forming roll carrier head on one of the two tool carrier ends 4-1, 5-1. In the working position, each forming roll bears in its shaping zone on the outer wall of the tube 2 and is driven along the axis of translation X1—X1, the four axes of orientation each pass through the shaping zone of the corresponding forming roll and, under optimum control conditions, intersect the axis of translation. The axes of orientation are arranged at 90° relative to each other about the axis of translation X1—X1.

The carriages 4 and 5 comprise means for translation which allow them to come together to bring the forming rolls 6, 7, 8, 9 into a working position against the outer wall of the tube 2, or more them apart each times that a fin-forming phase has ended, or, for example if control or maintenance operations have to be carried out.

Figure 5:
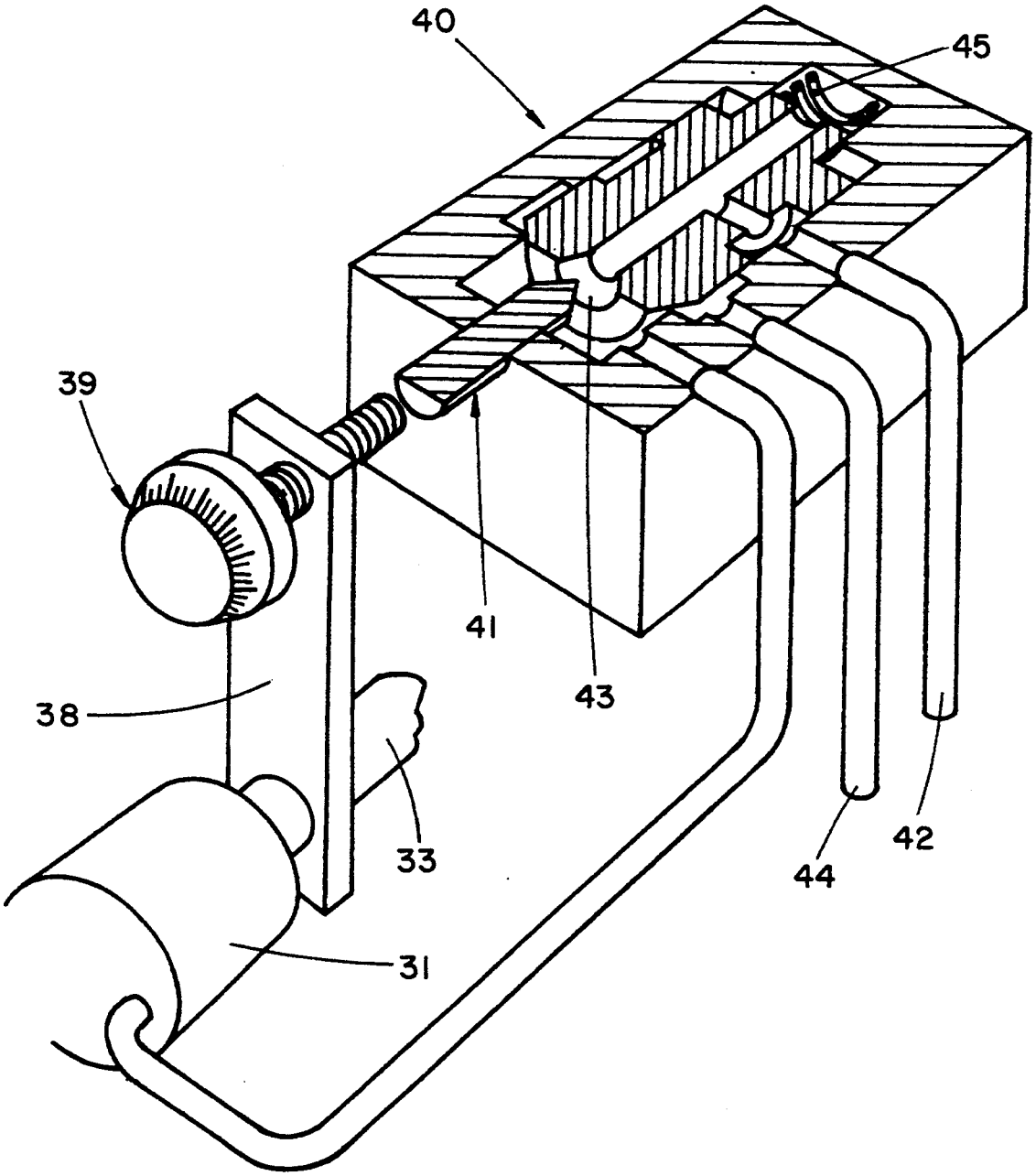
FIG. 5 is a schematic view of the control means at the end of the travel of the carriages in FIGS. 3 and 4, in the working position.

FIGS. 3, 4, 5 describe an embodiment of a means for translation of the carriages 4, 5.

FIGS. 3 and 4, only the lower part of each of the two carriages is shown as sliding on the slides 4A and 5A, the tool carrier ends 4-1, 5-1 and forming roll carrier heads not being shown.

FIG. 3 corresponds to the moved apart position of the forming rolls, and FIG. 4 shows the position where the forming rolls are brought together and are in the operating position. The axis of translation X1—X1 is marked in both drawings. The means for translation is the jack, comprising the cylinder 31 which is accommodated in the carriage 4 and the piston 32 which moves along on axis perpendicular to X1—X1. The end of the rod 33 of the piston 32 which passes beneath the swinging beam 34 is integral with the carriage 5. The centre of the swinging beam 34 is rotatably mounted about a pivot of a vertical axis X6 which intersects X1—X1. Two rigid rods 35, 36 are each connected by one of their ends 35A, 36A to the front ends of the carriages 4 and 5 and by the other end 35B, 36 B to the swinging beam. Symmetrical displacement is thus produced of the two carriages relative to the axis of translation X1—X1. The jack also comprises an auxiliary piston 37 of reduced section which allows the two carriages to be quickly moved apart at the end of a fin-forming operation. A means for accurately determining the point at which the carriages stop in the working position makes it possible for a precise determination of the distance between the axis of the tube and the forming rolls and thus the extent to which these latter penetrate the tube. The means comprises a rigid lateral arm 38, one end of which is connected to the rod of the piston 33, and the other end of which is connected by the intermediary of a micrometric screw 39 to a control means 40 for supplying the jack 31 with high pressure fluid.

FIG. 5 shows schematically an embodiment of this control means. It can be seen that the rigid arm 38 allows the rod of the piston 33 to drive the micrometric screw 39 until it comes to bear upon a closure means 41 which closes the orifice for intake of high pressure fluid coming from the pipe 42 towards the cylinder 31 of the jack and stops its movement. If displacement is not stopped, the valve seat 43 retracts and causes a passage for fluid to open towards the discharge channel 44. A return spring 45 closes the valve seat 43 if the rod of the piston 33 retracts. This means for adjusting the point at which the carriages stop therefore allows in a safe and reproducible way a constant and reproducible position to be provided for each forming roll on the tube wall to be provided with fins.

Figure 6:
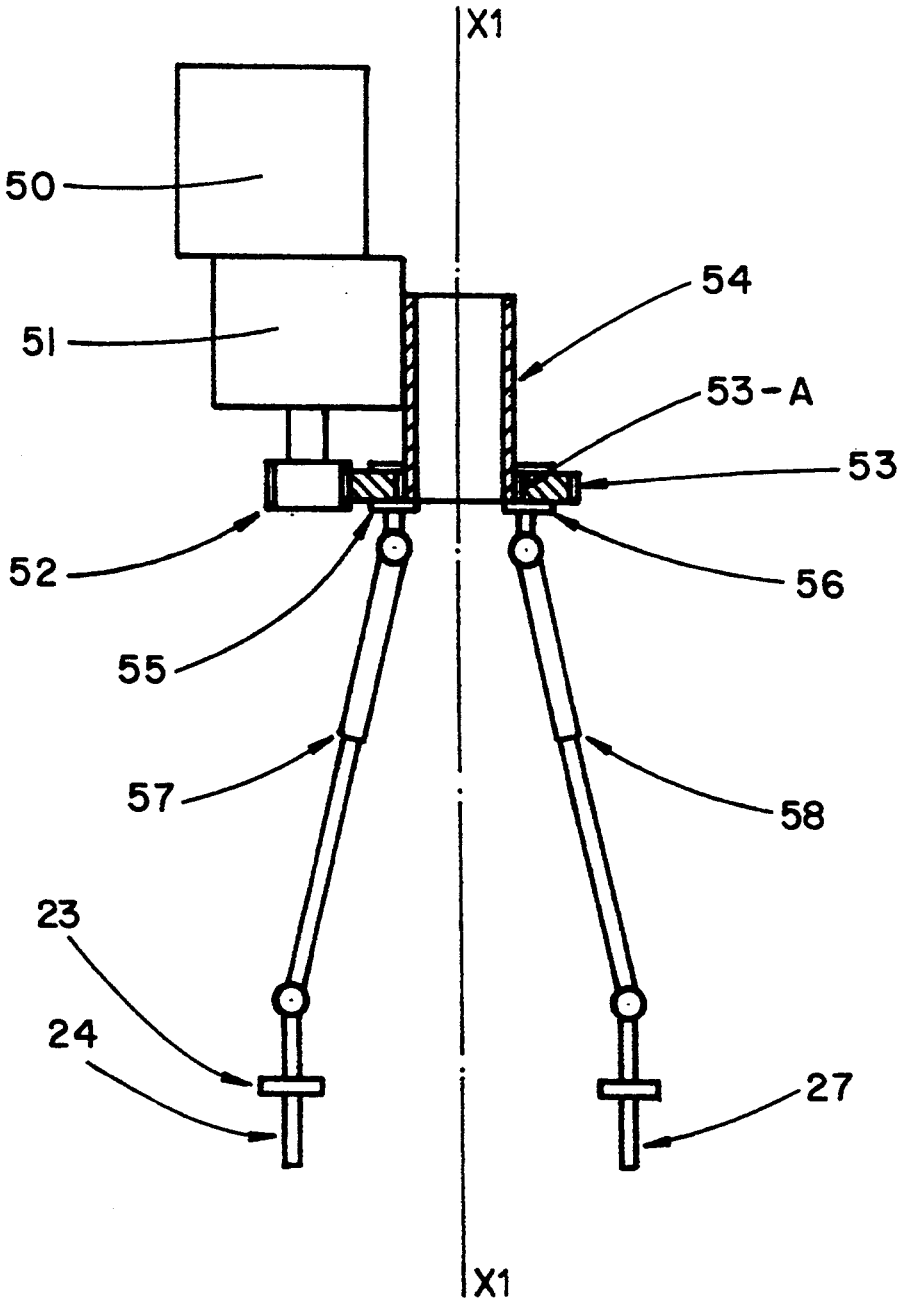
FIG. 6 is a schematic view along the sectional plane VI—VI of FIG. 1, showing the motor means and the transmission means between the motor means and the drive shafts driving the forming roll carrier shafts.

The four drive shafts 24, 25, 26, 27 which drive the four forming roll carrier shafts 18, 19, 20, 21 are mounted parallel to these latter and are driven at strictly equal speeds, by virtue of means shown schematically in FIG. 6. This drawing is a plan view along the section VI—VI of FIG. 1. FIG. 6 show only schematically the two lower drive shafts 24 and 27 to the rear of the plane of FIG. 1, and also the transmission means which connects them to the single motor means which is also shown schematically. The motor means comprises a direct current motor 50 of high power with a speed which can be varied within a large range and with a strong starting torque, connected by a transmission means 51 having a toothed pinion 52 with a toothed rim wheel 53 of an axis X1—X1, only the lower half of which is visible. The toothed rim wheel is mounted on bearing surfaces 53A of an inner tubular support 54 connected to a fixed chassis not shown. A guide tube, not shown, allows the tube which is to be provided with fins to pass inside the tube 54 along X1—X1. Four pinions mesh on this toothed wheel rim 53, driven by the pinion 52, only two pinions of which 55 and 56 are visible, each driving a transmission shaft connected to one drive shaft 24, 25, 26, 27. In FIG. 6, only the two lower pinions 55, 56 are visible which drive the lower transmission shafts 57, 58 which are themselves connected to the lower drive shafts 24, 27. The four drive pinions, such as 55, 56 are arranged uniformly about the toothed rim 53 at 90° relative to each other, in such a way that the transmission shafts are also distributed uniformly about the axis X1—X1 of translation which is corresponding tot he axis of the toothed rim wheel 53.

The four transmission shafts such as 57, 58 are telescopic and are provided at their ends with cardan joints. They therefore enable the four drive shafts and thus the forming roll to be driven at the same speed without coming into contact, even during translation of the carriages 4 and 5.

The four forming rolls 6, 7, 8, 9 with which the device 1 is provided are identical in structure. They preferably each comprise an assembly of discs of revolution. The diameters of which and profile of the shaping edges of which are designed for the gradual formation of fins, with the shaping edges of the forming rolls penetrating successively into the tube wall, within the grooves already initiated by the discs of the previous forming roll(s) along a helical path of movement on the tube wall. To obtain such a result, use is made of forming rolls which comprise discs of revolution of increasing diameter and variable profile.

Figure 7:
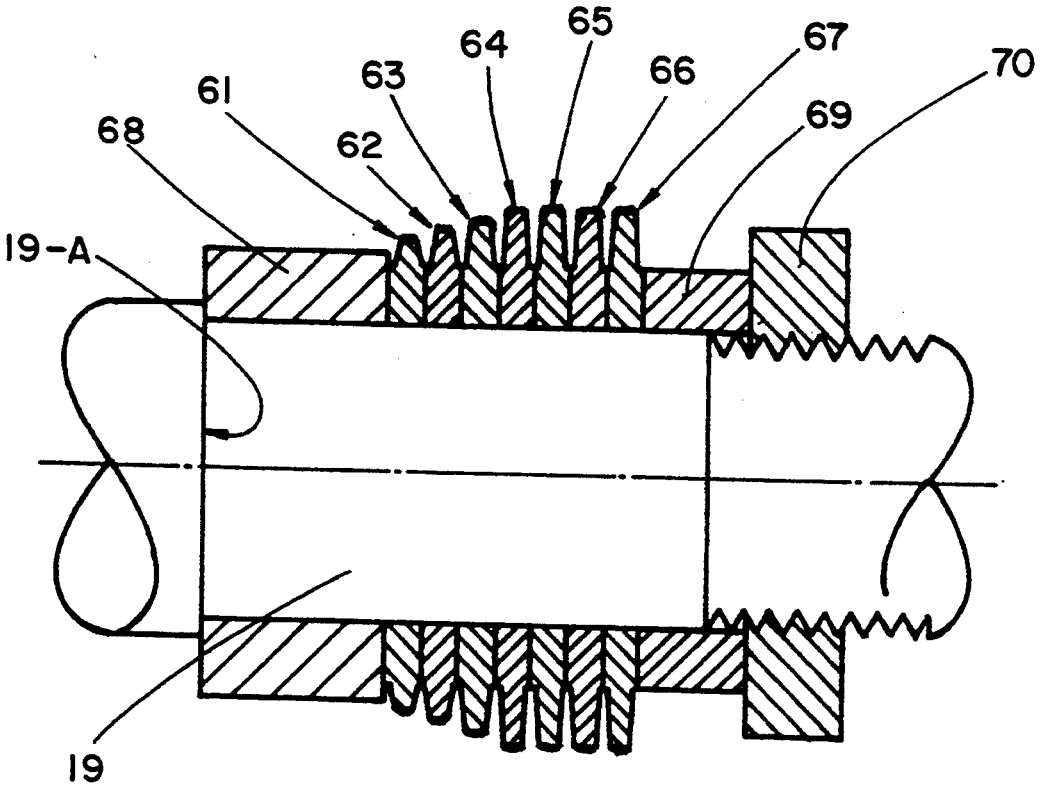
FIG. 7 is a schematic view of a forming roll in section, along a plane which includes the axis of the forming roll carrier shaft.

FIG. 7 shows schematically a section of a forming roll such as the forming roll 7, for example, of FIGS. 1 and 2, along a plane which includes the axis of the forming roll carrier shaft 19. The forming roll comprises, from its end of small diameter, which is oriented in a direction towards the smooth upstream part of the tube 5 shaping discs of revolution 61, 62, 63, 64, 65 which produce at least one gradually increasing helical fin by virtue of discs of increasing diameter passing successively into the same grooves. The last two disc 66, 67 which are equal in diameter to the disc 65 enable the profile of at least one helical fin to be equalised. The helical path made by the forming roll on the tube wall is obtained by the lead angle which is realised by the angular displacement of the forming roll carrier heads about their axis of orientation. Each of the four forming rolls must have a different axial setting along the forming roll carrier shaft so that the shaping edges of the discs penetrate within the grooves formed by the previous discs. This axial setting depends on the lead angle and on the number of helical fins, that is to say the number of threads of the helix. This axial setting is obtained by giving the desired width to the annular rings such as 68, 69 which are disposed on either side of the forming rolls such as 7.

As shown in FIG. 2, each forming roll carrier shaft such as 19 comprises a shoulder 19A which is disposed in the immediate vicinity of its drive pinion such as 22. The ring 68 which is disposed on the upstream side of the tube and which comes to bear against the shoulder 19A is therefore of a width which takes into account the axial spacing which must be provided between that forming roll and the next one disposed immediately upstream or downstream of it. The nut 70 which comes to bear on the ring 69 tightens the discs of the forming roll against the shoulder 19A.

Each forming roll carrier head such as 11 comes to bear, by virtue of a flat bearing plane perpendicular to tis axis of orientation X3, against a corresponding bearing surface 15 at the tool carrier end 4-1 of the carriage 4.

At least one angular setting means can be slid into at least one of the two gaps e1, e2 (see FIG. 1) existing between a cylindrical rod of revolution 72 integral with the forming roll carrier head 11, which has an axis which is perpendicular to the bearing surface 15 and a recess 73 provided int he end of the tool carrier 4-1 in which the end of the rod 72 engages.

By introducing thickness setting wedges into one and/or both of the spaces e1, e2 it is possible to vary the angular setting of the forming roll carrier head 11 about the axis X3 by a few degrees. This angular inclination relative to the plane of FIG. 1 does not exceed about 4° in the case of one single helical thread and about 8° in the case of a double helical thread.

The forming roll carrier head 11 is rotated about the axis X3 about a part of revolution 74 (see FIG. 2) which engages without clearance in the oppositely disposed recesses 75, 76 formed on either side of the bearing plane 15, and is held by a threaded rod 77. Parts forming stay rods such as 78, one end of which engages in an inverse T-shaped groove 79 in the forming roll carrier head 11, and the other end of which engages in a recess 79A provided in the tool carrier end 4-1 are capable of tightening the forming roll carrier head 11 on the bearing surface 15 by means of a transverse angle setting means 80, for example, which is drawn by a threaded part 81.

The possibility of easily separating each forming roll carrier head from the corresponding tool carrier end permits an easy adjustment to be made to the spacing between the 2 forming roll carrying heads of each tool carrier and permits a contact at 90° of the forming rolls on the tube as a function of the diameter of the tube. A metal blade of constant thickness and adequate surface area is introduced to this end in the bearing zone such as 15, this blade which is not shown comprising holes for passage of the axial part 74 of the stay rods such as 78 and of the part for angular setting 72. The angular setting of the forming rolls about the tube to be provided with fins is thus set at 90°, taking into account the diameter of the forming rolls and also the diameter, the thickness and the degree of reduction of the tube.

In certain instances it is necessary to support the tube wall which is subjected to the action of the forming rolls by using a mandrel 82 which is accommodated inside the tube 2 in the shaping zone, as shown in FIG. 2. The mandrel is approximately frustoconical in shape and the slope of its generatrix depends on the shaping conditions of the tube which is to be provided with fins. The mandrel is made in one piece with a retaining rod 83, the upstream end of which, disposed beyond the upstream end of the tube 2, is mounted freely to rotate in a way not shown in the attachment zone at a fixed point. It is also possible to mount the mandrel 82 directly freely rotating on the retaining rod 83. The position of the mandrel is advantageously adjustable in an axial direction.

As shown in FIG. 2, each forming roll carrier shaft such as 19 is mounted inside the corresponding forming roll carrier head such as 11 on bearings such as 84, 85 and is fixed at both ends by abutment bearings such as 86, 87 to prevent axial displacement.

The corresponding drive shafts such as 25 are mounted on bearings such as 88, 89 arranged on either side of the pinion 23 which meshes with the pinion 22 of the forming roll carrier shaft 19.

Each forming roll carrier head such as 11 in FIG. 2 is provided with a rapid dismantling means for the forming rolls, such as 7, which makes it possible to check whether the shaping discs have been worn out and thus whether the bearings of the shafts such as 19, 25 and the gear transmission means such as 22, 23 have been worn out. To this end, the bearings such as 84 of the forming roll carrier shaft 19 and such as 88 of the drive shaft 25 are mounted inside a detachable part 90 which is fixed to the rest of the structure of the forming roll carrier head 11 by a fixing means permitting fast assembly and removal.

The detachable part 90 can be withdrawn, after the two carriages 4, 5 have been moved away from the axis of movement X1—X1 by unscrewing the two bolts 91, 92. These pins block the detachable part 90 in a position against a bearing surface 93 of the forming roll carrier head.

The end of the detachable part comprises a projecting abutment edge 94 which forms a dihedral angle, the edge of which engages in a re-entering edge 95 of the same angle. The stems of the bolts 91, 92 which are inclined at about 45° relative to the plane of the bearing surface 93 through which they penetrate and are connected to an attachment means 96 disposed on the other side of the bearing surface 93. The horizontal component of traction force of the bolts 91, 92 this effectively blocks the detachable part 90 against the bearing surface 93 and the re-entering edge 95.

After the detachable part 90 has been withdrawn, it is possible to remove the shaft 19 carrying the forming roll 7. It is thus possible to control the discs, to change them if necessary and also to modify, if necessary, the axial setting. It is also possible to completely dismantle the drive shaft 25 and thus the gear transmission means between the two.

The translation of the tube during the forming of the fins is done along the axis X1—X1, the tube being supported by a channel. The metal channel is preferably lined with plastics material to facilitate sliding movement and to prevent the tube becoming caught in any way which would risk damage to the tube and tis fins.

To initiate the operation of providing the tube with fins, and to interrupt this operation, detection means, are provided at predetermined spacings apart from the shaping zone, along the axis of movement close to the channel which supports the tube. Each detection means provides a signal upon the passage of the front end of the tube. The detection means are of the Foucault current type, or proximity detectors, for example.

The output signals of the proximity detectors connected to electronic means which interrupt the operation of providing the tube with fins when an output signal is present or resume the operation when an output signal is absent.

Each zone provided with fins on a tube uses 2 electric boxes which are connected to a bus bar: one box with one detection means for initiating the fin-providing operation, one box with 2 detection means: one controlling passage at the low rotating sped of the forming rolls, and the other controlling movement of the return piston and stoppage of the rotation of the forming rolls.

It should be noted that if the forming rolls do not decelerate at the end of the fin-providing operation in a zone with fins, it is impossible to accurately form the specified lengths with fins due to the relatively fast feed of the tube.

The bus bar is formed of 3 wires which extend from the automated device of the shaping device and run along the channel guiding of the tube which can be 40 m, for example. The device can thus have 40 places of connection to the bus bar along the guiding channel, which allows 20 different fined zones to be formed over the length of the tube. These 3 threads of the bus bar thus prevent the use of 60 threads which would have been needed if all the detection means had had to be wired to the device autonomously.

Moreover, the bus bar manages coherence of sequential data: for example, if, right in the middle of a fin-providing operation, the piece of information "start of fin-providing operation" reaches the automated part of the device because 2 boxes with detection means have been inverted, the bus bar allows this error to be dealt with.

Initiating the operation of providing the tube with fins, such as an austenitic stainless steel 316L tube of ca. 16 mm outer diameter is done in the following way: the smooth tube which is ca. 25 m in length is placed over the channel from the downstream end. A pinch-roll (drive roller), not shown, enables to engage it over the mandrel 82 and over its retaining rod which has already been fixed to its attachment point. After it has been put in place, the motor is started in order to drive the four forming rolls at reduced speed of about 300 r.p.min. Movement at reduced speed of the jack 31 is then initiated to bring the two carriages 4 and 5 together into their working position. The forming rolls are then gradually tightened on the wall of the tube 2 which is held by the mandrel, and the tube is driven rotatably by the forming rolls in the opposite direction to the forming rolls, with a predetermined lead angle. As soon as the position of the forming rolls corresponding to the operative spacing is reached, the rotational speed of the forming rolls is accelerated until the operating speed of ca. 1400 r.p./min is reached. Under these conditions, depending on the type of forming rolls used, and depending on the lead angle and axial setting selected, it is possible to obtain a speed of translation in the order of 4 m/min when forming a single helical fin and about 8 m/min for double helical fin. By suitably selecting the reduction degree, the profiles and the force with which the forming rolls are tightened against the wall of the tube, within the range of 20 to 40 KN per forming rolls, it is possible to produce a tube with fins which is about 14 mm in outer diameter at the foot of the fins, with 1 mm of fin height, with a tube thickness of 0.9 mm at the foot of the fins and with a density of about 30 turns per inch in the axial length of a single thread. At the end of the forming rolls operation, after reduction of the rotational speed of the forming rolls for the purpose of controlling the finned length in a precise manner, it is possible to stop the operation almost instantly without transition by quickly actuating the return piston 37 of the jack.

A large number of variants can be made of the device according to the invention and of its described embodiment which do not come outside the scope of the invention.

What is claimed is:

1. A device for the forming of at least one helical fin (3) on the outer wall of a tube (2) comprising:

first and second carriages (4, 5) arranged opposite each other symmetrically in a shaping zone on either side of the tube, the axis of the tube defining an axis of translation (XI—XI), translation means for moving said first and second carriages to approach each other to a working position and for moving apart from each other, each of said first and second carriages having a pair of carrier heads (10, 11), (12, 13), each carrier head including a forming roll (6, 7, 8, 9), a carrier shaft (18, 19, 20, 21), a drive shaft (24, 25, 26, 27) for driving said carrier shaft and thus rotating the forming roll, rotary transmission means (22, 23)

motor means (50), said motor means driving the transmission means and said transmission means driving each drive shaft at the same speed, each of said carrier heads having its orientation axis (X2, X3, X4, X5) and being movable about its axis, and said carrier heads being arranged so that the relative angle formed between the orientation axes is 90, the orientation axes intersecting the tube shaping zone when the forming rolls are in working position.

2. A device according to claim 1 wherein the means for translation of the two carriages (4, 5) makes it possible for these carriages to be brought towards each other or moved away from the axis of translation (XI) of the tube (2) is at least one jack having a cylinder (31) which is integral with the first of the carriages (4), a rod (33) of at least one piston (32) being connected to the second of the carriages (5).

3. A device according to claim 1 or claim 2 further including means for synchronising the translation of the carriages (4, 5) having a swinging beam (34) mounted to a fixed pivot, the vertical axis (X6 of which intersects the axis of translation (XI—XI) of the tube, the ends (35B, 36B) of the beam each being connected by means of a rigid rod (35, 36) to an end (35A, 36A) of each carriage (4, 5).

4. A device according to claim 2 additionally comprising means for accurate adjustment of the end of the travel of said at least one piston (32) of said jack, the accurate adjustment means including closure means (41) for the pipe (42) supplying the cylinder (31) of the jack with high pressure fluid, said closure means cooperating with the rod (33) and the piston (32) of the jack, and a control means (39) permitting accurate adjustment of the length of the travel of the rod (33) of the piston (32), the closure means operating to interrupt high pressure fluid supply to the cylinder.

5. A device according to one of claims 1 or 2 wherein each forming roll carrier shaft (18, 19, 20, 21) is perpendicular to the corresponding axis of orientation (X2, X3, X4, X5) which it intersects.

6. A device according to one of claims 1 or 2 wherein each forming roll carrier shaft (18, 19, 20, 21) and the corresponding drive shaft (24, 25, 26, 27) are mounted on a forming roll carrier head (10, 11, 12, 13) which bears against the tool carrier end (4-1, 5-1) of a carriage (4, 5) by virtue of a bearing surface (14, 15, 16, 17) which surface is perpendicular to the corresponding axis of orientation (X2, X3, X4, X5), and a means for angular setting (72, 73) enabling each forming roll carrier head to rotate a few degrees about its axis of orientation.

7. A device according to claim 6 further including setting means for the forming roll carrier head (10, 11, 12, 13) to displace the forming roll carrier head along its axis of orientation.

8. A device according to claim 7 wherein said setting means is introduced into the bearing surface (14, 15, 16, 17) and the angular position of the forming roll about the tube is adjusted to 90°.

9. A device according to claim 6 wherein each forming roll carrier head (10, 11, 12, 13) comprises a detachable part (90) inside which is accommodated at least one bearing of the forming roll carrier shaft, this detachable part, when dismantled, permitting removal and, if necessary, replacement, of the forming roll (6, 7, 8, 9).

10. A device according to one of claims 1 or 2 wherein each of the drive shafts (24, 25, 26, 27) is connected with said motor means (50) by transmission means including a telescoping shaft (57, 58) which is pivotally connected to each drive shaft.

11. A device according to claim 10 wherein the transmission means between the motor means (50) and the drive shafts (24, 25, 26, 27) also comprise a toothed rim wheel (53) through which the axis of translation (X1—X1) of the tube (2) passes, said toothed rim wheel is being driven by a toothed pinion (52) which is connected to the motor means (50) and the toothed rim wheel is driving four toothed pinions (55, 56 which are disposed at 90° relative to each other about the axis of translation (X1—X1), each pinion driving a telescoping shaft (57, 58).

12. A device according to one of claim 1 or 2 wherein each forming roll (6, 7, 8, 9) is constituted of a plurality of discs of revolution (61, 62, 63, 64, 65) having the same axis as the forming roll carrier shaft (18, 19, 20, 21), the side of each forming roll being oriented towards the smooth upstream part of the tube (2) which is to be provided with fins comprising at least one disc (61, 62, 63) which is less in diameter than a following disc, the forming roll being held to its forming roll carrier shaft by at least one axial setting means which allows the axial position of the forming roll to be adjusted on the corresponding forming roll carrier shaft relative to that of the other forming rolls.

13. A device according to one of claims 1 or 2 wherein the wall of the tube (2), during the operation of providing it with the fins, is held in the shaping zone by an internal mandrel (82) of appropriate frustoconical shape, said mandrel being connected to the retaining rod (83), an upstream end of this retaining rod itself being attached to a fixed point situated beyond the upstream end of the tube (2).

14. A device according to claim 13 wherein the mandrel (82) is mounted to freely rotate about the axis of translation (X1—X1).

15. A device according to claim 1 wherein the tube (2) is supported, along the axis of translation (X1—X1), by channels which are covered, at least for the length of the tube with a fin, with a layer of plastic material.

16. A device according to claim 1 wherein at least one drive roller engages the tube (2) in the forming rolls prior to the operation during which the tube (2) is provided with fins.

17. A device according to claim 16 wherein a group of proximity detection means is provided, such proximity detection means being connected to electronic means which operate to set in motion or to interrupt the operation of fin generation so that predetermined tube zones are not provided with a fin.

18. A device according to claim 17 wherein the detection means is connected to the electronic means by way of a bus bar which permits a very large number of connections to be made and which thus allows a plurality of finned zones and non-finned zones to be formed on the tube.

19. A device according to claim 18 wherein starting of the fin-providing operation is controlled by the electronic means, so that after placement of a smooth tube (20), the setting in motion of the forming rolls which are disposed at a spacing away from the axis of translation (X1—X1) occurs at a reduced operating speed, then setting in motion the jack in order to gradually bring the forming rolls (6, 7, 8, 9) closer to the wall of the tube (2) until each forming roll gradually increases pressure against the wall of the tube (2), then automatically stopping operation of the jack by means of closure of the high pressure fluid intake and gradually increasing the speed of rotation of the forming rolls until a normal operating speed is reached.

20. A device according to claim 18 wherein the operation of providing the tubes with fins is stopped by a group of proximity detection means which decelerates the speed of rotation of the forming rolls, and then actuates the return piston (37) so as to move the carriages (4, 5) away from the axis (X1—X1) and interrupts rotation of the forming rolls.

21. A device according to claim 17 wherein starting of the fin-providing operation is controlled by the electronic means, so that after placement of a smooth tube (20), the setting in motion of the forming rolls which are disposed at a spacing away from the axis of translation (X1—X1) occurs at a reduced operating speed, then setting in motion the jack in order to gradually bring the forming rolls (6, 7, 8, 9) closer to the wall of the tube (2) until each forming roll gradually increases pressure against the wall of the tube (2), then automatically stopping operation of the jack by means of closure of the high pressure fluid intake and gradually increasing the speed of rotation of the forming rolls until a normal operating speed is reached.

22. A device according to claim 17 wherein the operation of providing the tubes with fins is stopped by a group of proximity detection means which decelerates the speed of rotation of the forming rolls, and then actuates the return piston (37) so as to move the carriages (4, 5) away from the axis (X1—X1) and interrupts rotation of the forming rolls.

23. A device according to claim 1 or 2 further comprising proximity detection means disposed along the axis of translation (X1—X1) at pre-determined spacings from the shaping zone to provide a signal indicating the passage of the tube front end.

24. A device according to claim 1 wherein said motor means (50) comprises a single direct current motor of variable speed and high starting torque.

* * * * *